United States Patent [19]

Ament

[11] Patent Number: 4,930,167

[45] Date of Patent: Jun. 5, 1990

[54] TOILET WITH VORTEX FLUSHING ACTION

[75] Inventor: Myron J. Ament, Plano, Tex.

[73] Assignee: Household Manufacturing, Inc., Prospect Heights, Ill.

[21] Appl. No.: 249,513

[22] Filed: Sep. 26, 1988

[51] Int. Cl.[5] ..... E03D 11/08

[52] U.S. Cl. ..... 4/420

[58] Field of Search ..... 4/420, 421, 422, 424, 4/426, 428

[56] References Cited

U.S. PATENT DOCUMENTS

| | | | |
|---|---|---|---|
| 235,134 | 12/1880 | Demarest | 4/420 |
| 311,342 | 1/1885 | Mansur | 4/420 |
| 548,239 | 10/1895 | Wells | 4/348 |
| 705,319 | 7/1902 | Bush | 4/420 |
| 854,653 | 5/1907 | Knapp | 4/348 |
| 1,236,902 | 8/1917 | Bowen/Pettus | 4/300 |
| 2,164,320 | 7/1939 | Groeniger | 4/70 |
| 3,334,358 | 8/1967 | McPherson | 4/420 |
| 3,538,518 | 11/1970 | Helke et al. | 4/420 |
| 4,162,548 | 7/1979 | Groombridge et al. | 4/300 |
| 4,197,599 | 4/1980 | Tsai | 4/424 |
| 4,277,854 | 7/1981 | Tsai | 4/420 |
| 4,524,500 | 6/1985 | Genetay et al. | 4/420 |

OTHER PUBLICATIONS

0019449 European Patent Application, 11/26/80, Inventor-Gallimore.

*Primary Examiner*—Henry J. Recla
*Assistant Examiner*—Edward C. Donovan
*Attorney, Agent, or Firm*—Harness, Dickey & Pierce

[57] ABSTRACT

A one-piece toilet bowl and rim capable of generating superior vortex water flushing action is disclosed. Metering of the volume, flow rate, and directional orientation of the flushing water into, and within the internal rim cavity is developed by two flow passages of different diameters. The angular orientation of the flow passages generates fluid flow within the rim cavity in opposite directions. The flushing water flowing within the rim cavity is angularly discharged through a continuously slotted discharge orifice circumferentially located along the underside of the rim. The angularly discharged flushing water generates superior vortex flushing action within the toilet bowl.

21 Claims, 3 Drawing Sheets

TOILET WITH VORTEX FLUSHING ACTION

BACKGROUND OF THE INVENTION

1. Field of the Invention

This invention relates to toilets, and more particularly, to the novel association of water supply means and discharge means for controlling directional and volumetric fluid flow characteristics within the toilet, thereby generating a vortex flushing action.

2. Description of the Related Art

The basic function of a water closet is to dispose of waste material utilizing a water flushing action. Flushing efficiency is dependent on the volume and flow rate of the water introduced into the bowl and the water discharge means defined by the bowl rim. Typically, the flushing action generates a syphonic reaction which communicates the waste material to an externally connected exit path. Domestically accepted cleanliness and sanitational standards govern the methods of water flushing that are commercialized.

Traditionally, the water volume supply to the toilet bowl is communicated from a water tank through the rear of the bowl rim into a centrally defined rectangular reservoir channel. The reservoir channel defines the flow path of the water into an internal rim cavity. Typically, the flow into the reservoir channel is through a singular large diameter hole or multiple holes of the same diameter. Further, the water traveling through the reservoir channel perpendicularly strikes the inside wall of the inner rim cavity and is thereby forcibly diverted to opposite sides of the rim cavity. The two water streams traveling within the opposite sides of the rim cavity meet at the front of the bowl. There, the water is downwardly discharged onto the front wall surface of the toilet bowl. At the same time, water is downwardly discharged into the bowl through discharge orifices which are located on the underside of the rim. Typical rim discharge orifices include holes, slots, and a combination thereof, which can be aligned perpendicular to the underside surface of the rim or oriented angularly toward the bowl. These discharge orifices are not originally formed into the toilet bowl rim assembly, thereby necessitating secondary manufacturing operations.

Furthermore, the downward water action generated within traditional bowl and rim assemblies allows a substantial volume of the flushing water to enter the exit path prior to the waste material. Therefore, additional water volume is typically required to insure thorough bowl cleaning and adequate syphonic fluid motion.

SUMMARY OF THE INVENTION

Accordingly, it is a primary object of the present invention to provide for a toilet with rim feed and discharge means that generate vortex flushing action.

Another object of the present invention is to provide for superior cleaning and sanitizing characteristics pursuant to the pro-active vortex water flushing method.

A further object of the present invention is to provide a vortex flushing method that substantially reduces the volumetric water requirements.

Additionally, it is an object of the present invention to provide a vortex flushing method that provides for improved syphonic action, thereby generating superior waste removal proficiency.

These and other objects of the present invention will be apparent by providing a one-piece toilet bowl and rim construction for water closets capable of generating the superior vortex flushing action. Control of the volume, flow rate and directional orientation of the flushing water into and within the rim cavity and thereafter, through a slotted rim discharge orifice, produce the vortex flushing action. The volume and flow rate into the rim cavity from an external water supply is metered by utilizing two flow passages of different diameters. The angular orientation of each passage to the other, to the outer wall of the rim cavity and to the slotted rim discharge orifice defines the degree of vortex action desired. The centrally located reservoir channel found in traditional toilet bowl configurations has been eliminated so as to allow direct communication of water from the external water supply into the rim cavity. Each flow passage is oriented to provide flow of water to only one side of the rim cavity. The diameter of the larger flow passage is developed to produce flow through approximately 270° of the rim cavity circumference. The smaller flow passage diameter provides communication of water in the opposite direction within the rim cavity to the remaining rim circumference. As the water travels within the rim cavity, it is angularly discharged through the slotted discharge orifice circumferentially located on the underside of the rim. The discharged water continues to travel within the bowl in a swirl-like profile. This swirling vortex action pro-actively generates improved self-cleaning characteristics. Additionally, the swirling water action produces improved syphonic action thereby permitting usage of a reduced fluid volume.

BRIEF DESCRIPTION OF THE DRAWINGS

Various advantages of the present invention will become apparent to one skilled in the art upon reading the following detailed description and by reference to the following drawings in which.

DETAILED DESCRIPTION OF THE PREFERRED EMBODIMENTS

Conventional toilet water flushing methods are well known in the art. The novelty of the present invention which generates improved water efficiency, cleaning characteristics and waste removal capabilities warrants utility in either domestic or industrial application.

Figure 1:
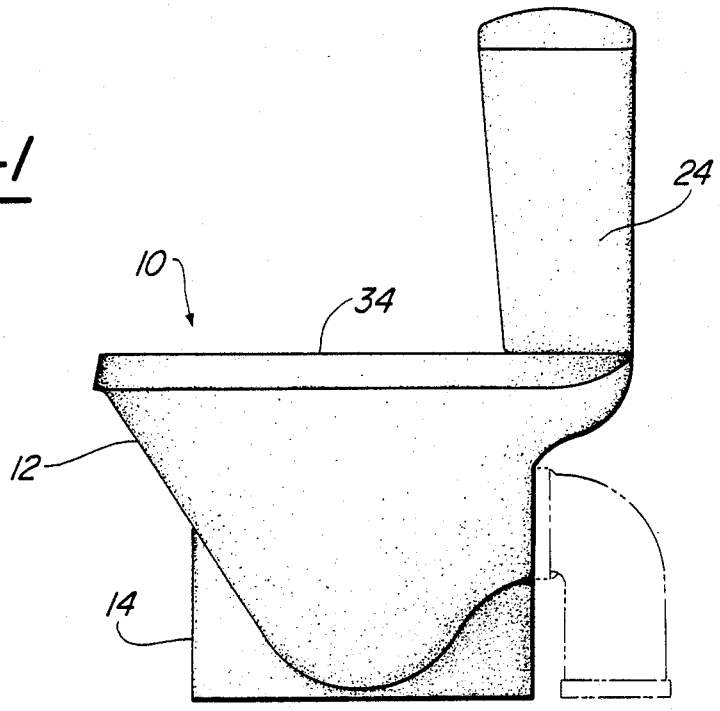
FIG. 1 is a general representation of the one-piece toilet according to the preferred embodiment of the present invention, in operative association with a typical water closet tank.
Figure 2:
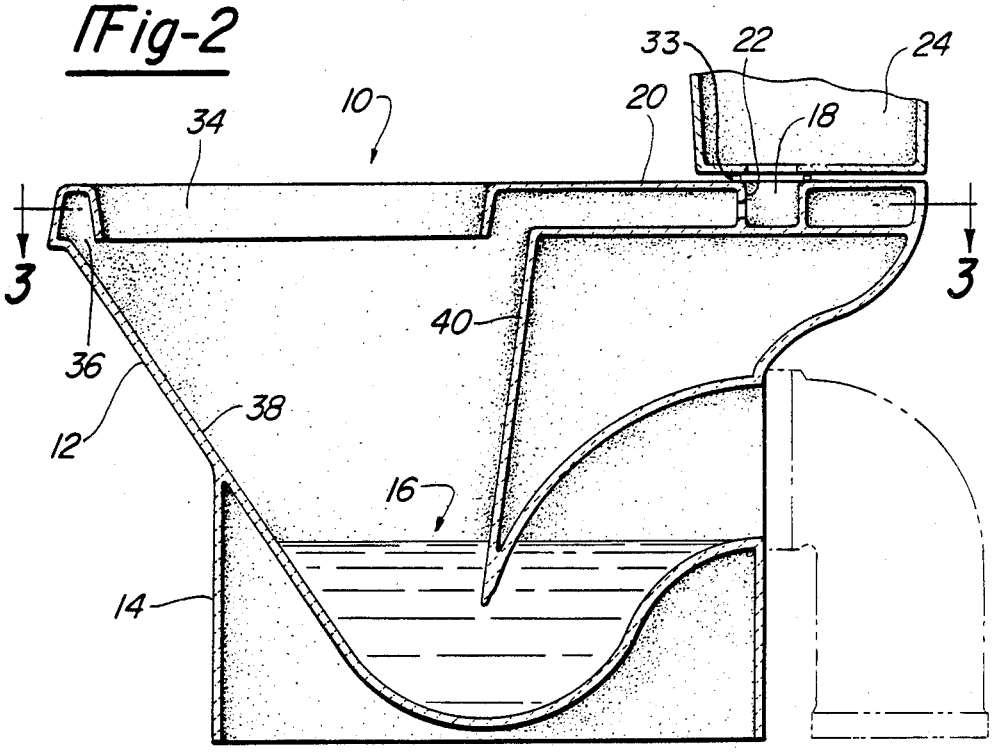
FIG. 2 is a side elevational view in vertical cross-section of FIG. 1.

With particular reference to FIGS. 1 and 2, the one-piece toilet 10 according to the preferred embodiment of the present invention is shown. The present invention provides a toilet 10 having traditional bowl 12, support 14 and waste outlet 16 features. The toilet 10 of this invention is adaptable for application with any externally supplied water source 24. The novelty of the present invention lies in the method of introducing, metering, and directing water so as to generate vortex fluid motion for waste removal.

Externally supplied water is introduced into the toilet 10 through a rim feed reservoir 18. The rim feed reservoir 18 is located at the rear of the toilet base upon its horizontal top surface 20 and is generally cylindrical in configuration. The rim feed reservoir 18 includes a vertically aligned wall 22 integrally formed therein. The rim feed reservoir 18 is dimensioned to control the volume of water received from the external water source 24. Additionally, a gasket 33 water-tightly seals the water flowing from the external water source 24 to the rim feed reservoir 18.

Figure 4:
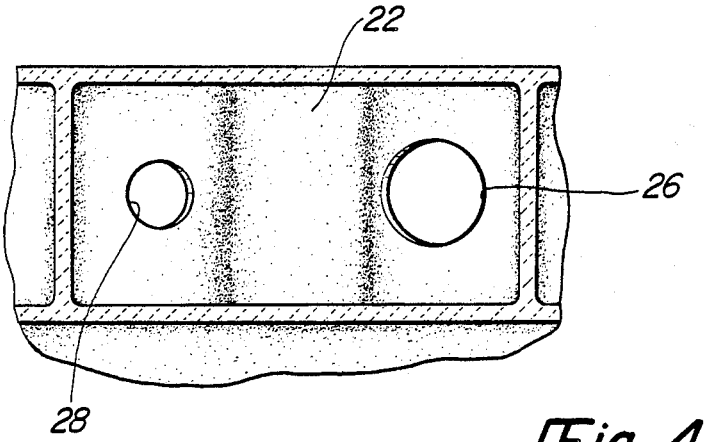
FIG. 4 is a vertical sectional view taken along the line 4—4 of FIG. 3, showing the different diameter flow passages and their angularity within the inner rim cavity.
Figure 3:
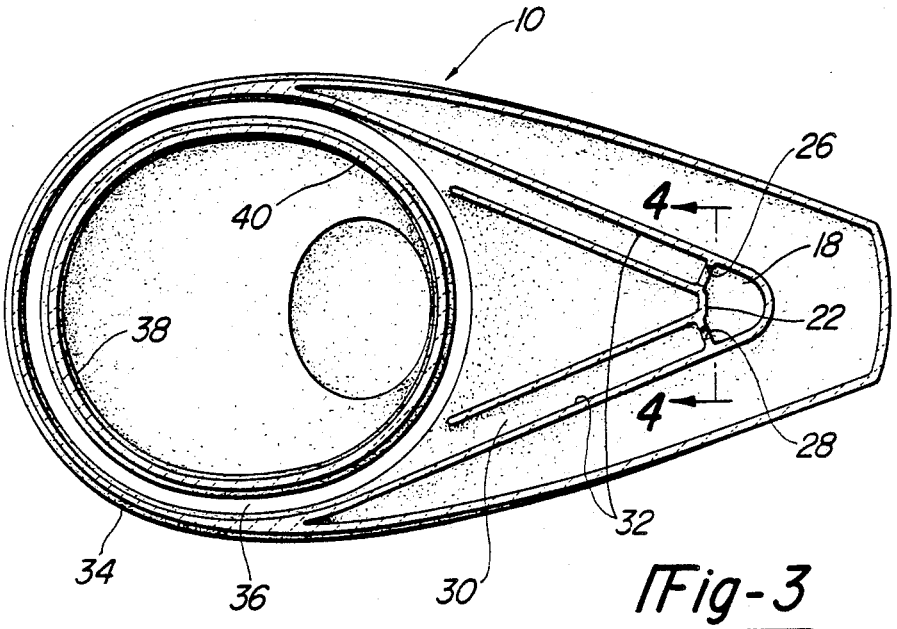
FIG. 3 is a horizontal sectional view taken along the line 3—3 of FIG. 2, showing the inner rim cavity profile and rim discharge passage.

With particular reference now to FIGS. 3 and 4, the one-piece toilet 10 according to the present invention is shown. Located within the rim feed reservoir 18 are two flow passages 26 and 28 which allow fluid communication of the water between the external water source 24 and the internal rim cavity 30. The first flow passage 26 is of a greater diameter than that of the second flow passage 28. The two flow passages 26 and 28 are angularly oriented toward the outer wall 32 of the rim cavity 30. The two flow passages 26 and 28 are located on the vertical cylindrical wall 22 of the rim feed reservoir 18 and are laterally oriented in outward angular relation thereon.

Because of their lateral and angular orientation relative to each other, the passages 26 and 28 are directed at opposite sides of the rim cavity 30. Water introduced through the first flow passage 26 communicates within the rim cavity 30 in one direction while simultaneously the second flow passage 28 communicates within the rim cavity 30 in the opposite direction. The larger diameter of the first flow passage 26 provides the primary flow direction and accounts for approximately 270° of travel within the rim cavity 30.

Referring to FIGS. 2, 3, 5 and 6, further features of the present invention are shown. Disposed on the horizontal underside of the rim 34 is a discharge slot 36. The discharge slot 36 extends around the entire circumference of the rim 34. The discharge slot 36 provides the communicative path between the internal rim cavity 30 and the inner bowl wall 38. The water introduced at the rim feed reservoir 18 passes through the flow passages 26 and 28 such that water traveling within the rim cavity 30 is discharged through the discharge slot 36 onto the inner bowl wall 38 of the bowl 12. This invention produces direct unrestricted flow within and around the rim cavity 30 with said circumferential motion continuing upon discharge through the discharge slot 36. Circumferential flow along the inner bowl wall 38 in combination with loss of fluid velocity around the circumference thereof, generates swirling top to bottom water action. The flow characteristics defined by the diameter and angular orientation of the flow passages 26 and 28 determine the degree and amplitude of the vortex action within the bowl 12.

Figure 5:
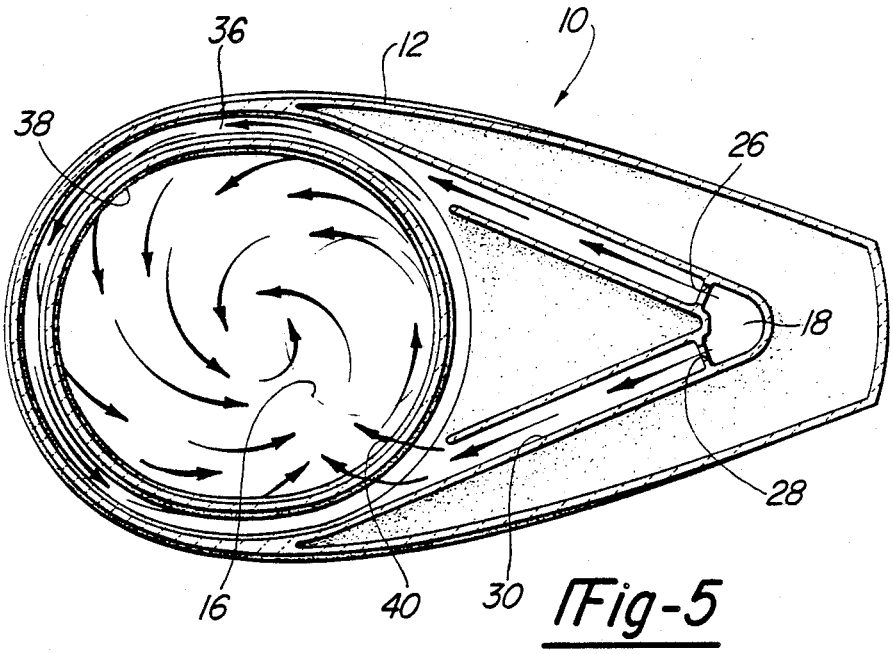
FIG. 5 is a schematic representation of the vortex water flow within the rim cavity and through the circumferential discharge slot into the bowl according to the present invention.
Figure 6:
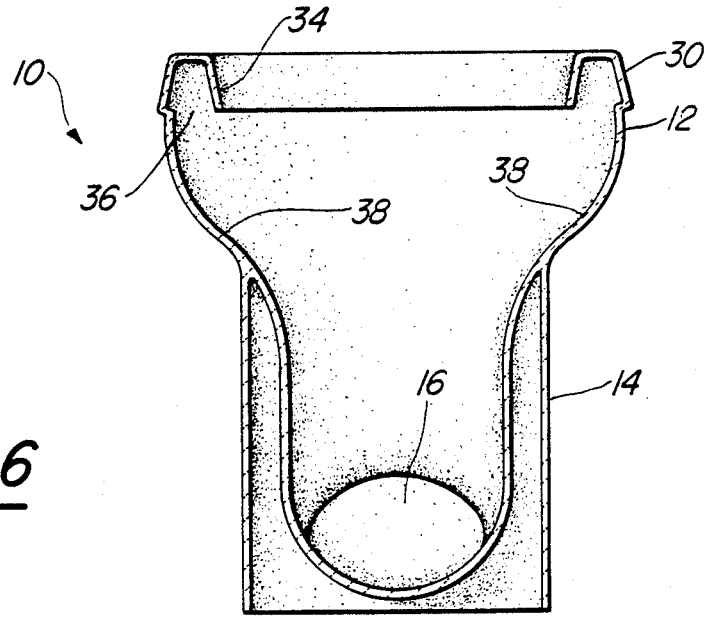
FIG. 6 is a front elevational view in vertical cross-section illustrating the internal rim cavity and discharge slot orientation.

FIG. 5 presents a diagrammatic illustration of a fluid flow profile within the rim cavity 30 and subsequently through the discharge slot 36 and onto the inner bowl wall 38 in accordance with the preferred embodiment of the present invention. The volumetric flow through first flow passage 26 is sufficient to generate substantial flow within the rim cavity 30. The second flow passage 28 basically ensures sufficient wetting and cleaning of the rearward portion of the bowl surface not supplied by the first flow passage 26. That area being particularly defined by rearward wall 40 of the bowl 12.

FIG. 5 also details the improved syphonic reaction generated through the waste outlet 16 shown in FIG. 2. Waste material within the bowl 12 is pushed, pursuant to the vortex action, into the waste outlet 16 in front of the flushing water. Conventional flushing concepts allow waste to remain at the surface of the flushing water and enter the waste outlet 16 subsequent to the majority of the water. This tends to promote inefficient disposal of waste through externally connected waste removal systems. According to the preferred embodiment of the present invention, superior syphonic activity is generated within the bowl 12 because of the increased water velocity and waste pushing action produced by the vortex flushing action.

FIG. 5 also illustrates the present invention's capability to provide superior bowl cleaning properties. Similar to the improved syphonic action, the increased water velocity, swirling action and early removal of the waste from the bowl combine to generate superior bowl cleaning performance.

The preferred embodiment of the present invention is a one-piece component. It simplifies the construction and secondary operations required and thereby makes the toilet less expensive to manufacture and assemble while at the same time achieves a superior flushing action pursuant to the vortex motion of the flushing water.

While it is apparent that the preferred embodiment of the present invention disclosed is well calculated to fulfill the objects above stated, it will be appreciated that the invention is susceptible to modification, variation and change without departing from the proper scope or fair meaning of the invention.

What is claimed is:

1. A one-piece molded toilet comprising:

a bowl;

a rim feed reservoir integral with said bowl and operative to connect said bowl with an external water supply source;

a rim integral with said bowl and extending generally around the periphery of said bowl, said rim defining an internal rim cavity;

a continuous rim discharge passage provided on the underside of said rim within said bowl; and passage means for producing vortex flushing within said bowl, said passage means including at least two flow passages fluidly connected between said rim feed reservoir and said internal rim cavity, said passage means, rim feed reservoir, and said rim and bowl being of a one-piece molded construction, said first flow passage diameter being different than the diameter of said second flow passage and wherein said first flow passage provides fluid communication between one side of said rim cavity and said rim feed reservoir in a first direction, and said second flow passage providing fluid communication between an opposite side of said rim cavity and said rim feed reservoir in a second direction such that fluid discharged through said rim discharge passage into said bowl generates top to bottom swirling fluid motion in said bowl.

2. The toilet according to claim 1, wherein said bowl comprises a generally cylindrical rim feed reservoir operatively connecting said bowl with an external water supply source, said bowl including a hollow rim extending substantially around its periphery defining an inner rim cavity and having a continuously slotted discharge passage disposed on the underside of said rim within said bowl.

3. The toilet according to claim 2, wherein said first flow passage diameter is greater than twice the diameter of said second flow passage, thereby permitting delivery of a greater volume of water to said rim cavity through said first flow passage in said first direction.

4. The toilet according to claim 3, wherein said first and second flow passages are adjacently positioned on a vertical wall of said rim feed reservoir, the axis of said first and second flow passages are outwardly angularly disposed toward opposite outer walls of said internal rim cavity, thereby directing water from said first flow passage through one side of said rim cavity while directing water from said second flow passage through the opposite side of said rim cavity.

5. The toilet according to claim 4, wherein said water fluidly discharges from said rim cavity into said bowl, said discharging water maintaining circumferential fluid motion generated within said rim cavity, thereby developing swirling fluid motion within said bowl so as to generate said vortex flushing.

6. The toilet according to claim 5, wherein the amplitude, degree and fluid speed of said vortex motion within said bowl is defined by the predetermined proportional relationship of said first and second flow passage diameters and their oppositely oriented angularity within said rim cavity, said relationship defines the subsequent vortex motion within said bowl following discharge.

7. A method of generating vortex flushing for removing waste material from a one-piece molded toilet having a bowl, said method comprising the steps of:

(a) introducing water from an external supply source into a rim feed reservoir integral with said bowl;

(b) providing first and second passage means integrally associated with said rim feed reservoir for introducing water from said rim feed reservoir into opposite respective sides of a rim cavity located within a rim which extends substantially around the periphery of said bowl and having a single continuous rim discharge passage disposed on the underside of said rim;

(c) metering the volumetric characteristics of said water flowing through said first and second passage means into said rim cavity so as to produce unequal volumetric characteristics to opposite sides thereof;

(d) controlling the directional fluid movement of said water flowing through said first and second passage means within said rim cavity;

(e) discharging said water within said rim cavity into said bowl through said single continuous rim discharge passage so as to generate top to bottom swirling vortex motion in said bowl.

8. The method as defined in claim 7, wherein said step of metering volumetric characteristics of said water entering opposite sides of said rim cavity is defined by said first and second flow passages having different diameters.

9. The method as defined in claim 8, wherein said step of metering is further defined by the diameter of said first flow passage being greater than twice the diameter of said second flow passage, thereby metering a greater volume of said water through said first flow passage in a first direction within said rim cavity.

10. The method as defined in claim 12, wherein said step of directionally controlling the fluid motion of said water within said rim cavity is defined by the outwardly disposed angularity of said first and second flow passages toward the respective opposite sides of said rim cavity.

11. The method as defined in claim 10 wherein said first flow passage angularity and large diameter creates primary fluid communication to one side of said rim cavity, thereby generating fluid movement within said rim cavity substantially around said rim circumference.

12. The method as defined in claim 7, wherein said step of discharging said water into said bowl comprises discharging said water through a continuously slotted discharge passage located on an underside surface of said rim, said slot oriented to discharge said water onto the inner walls of said bowl.

13. The method as defined in claim 12, wherein said slotted passage permits angular circumferential discharge of said water from said rim cavity, said circumferential discharge generating vortex flushing motion within said bowl.

14. A one-piece molded toilet comprising:

a bowl;

a rim feed reservoir, said rim feed reservoir operative to supply said bowl from an externally supplied water source;

a continuous rim extending around the periphery of said bowl which defines an internal rim cavity;

a continuously slotted rim discharge passage being disposed on the underside of said rim;

first and second flow passages of different diameters, provided on an integral vertical wall of said rim feed reservoir, said first and second flow passages permit water to fluidly communicate with opposite respective sides of said rim cavity from said rim feed reservoir; and means associated with said rim feed reservoir for producing vortex flushing within said bowl.

15. The one-piece toilet according to claim 14, wherein said means for producing vortex flushing comprises the angular positioning and diametric differences of said first and second flow passages.

16. The one-piece toilet according to claim 15, wherein said first flow passage diameter is greater than twice the diameter of said second flow passage thereby delivering a greater volume of flushing water to the side of said rim cavity respectively associated with said first flow passage.

17. The one-piece toilet according to claim 16, wherein said first and second flow passages are adjacently positioned, the axis of said first and second flow passages being outwardly and angularly disposed, thereby directing water from said first flow passage through one side of said rim cavity while directing water from said second flow passage through the opposite side of said rim cavity.

18. The one-piece toilet according to claim 17, wherein said water flowing within said rim cavity fluidly communicates with said bowl through said rim discharge passage, said discharged water maintaining circumferential fluid motion originally generated within said rim cavity, thereby developing swirling fluid motion within said bowl so as to create said vortex flushing.

19. A one-piece molded toilet bowl comprising:

a rim extending substantially around the periphery of said toilet bowl defining an internal rim cavity;

rim feed means for providing fluid communication between an external water supply source and said rim cavity, said rim feed means integral with said bowl;

a rim discharge passage defining a continuous slot disposed on the underside of said rim within said bowl;

first flow passage means for providing fluid communication between one side of said rim cavity and said rim feed means, said first flow passage means integrally associated with said rim feed means; and second flow passage means for providing fluid communication between an opposite side of said rim cavity and said rim feed means, said second flow passage means integrally associated with said rim feed means, said first and second flow passage means are of different sizes to permit delivery of a greater volume of water to one side of said rim cavity relative to said opposite side to be discharged through said rim discharge passage, and said first and second flow passage means producing vortex flushing within said bowl such that fluid discharge through said rim discharge passage into said bowl generates top to bottom swirling fluid motion in said bowl.

20. A one-piece molded toilet bowl according to claim 29 wherein said rim feed means comprises a generally cylindrical rim feed reservoir.

21. A one-piece molded toilet bowl according to claim 30 wherein said first and second flow passage means comprise a first and second flow passage extending through a generally vertically extending wall of said rim feed reservoir, said first and second flow passages being outwardly angularly disposed toward opposite respective sides of said rim cavity.

* * * * *

UNITED STATES PATENT AND TRADEMARK OFFICE

CERTIFICATE OF CORRECTION

PATENT NO. : 4,930,167

DATED : Jun. 5, 1990

INVENTOR(S) : Myron J. Ament

It is certified that error appears in the above-identified patent and that said Letters Patent is hereby corrected as shown below:

Col. 6, Line 3, Claim 10, "12" should be --7--;

Col. 8, Line 10, Claim 20, "29" should be --19--;

Col. 8, Line 13, Claim 21, "30" should be --20--.

Signed and Sealed this

Twenty-fourth Day of November, 1992

*Attest:*

DOUGLAS B. COMER

*Attesting Officer*

*Acting Commissioner of Patents and Trademarks*